United States Patent [19]

Resnick

[11] 4,342,350

[45] Aug. 3, 1982

[54] BUSINESS WALLET CONSTRUCTION

[76] Inventor: Lawrence Resnick, 110 Kenyon Ave., Pawtucket, R.I. 02861

[21] Appl. No.: 182,735

[22] Filed: Aug. 29, 1980

[51] Int. Cl.[3] ..... A45C 1/06

[52] U.S. Cl. ..... 150/35; 150/39

[58] Field of Search ..... 150/35, 38, 39; 281/31, 281/34, 19 R

[56] References Cited

U.S. PATENT DOCUMENTS

| | | | |
|---|---|---|---|
| 1,037,264 | 9/1912 | Kimmel | 150/35 |
| 1,479,791 | 1/1924 | Degenring | 281/34 |
| 1,683,996 | 9/1928 | Snow | 150/39 X |
| 2,008,220 | 7/1935 | Miyeno | 150/38 |
| 3,267,980 | 8/1966 | Bird | 150/35 |
| 4,126,168 | 11/1978 | Ganz et al. | 150/35 |
| 4,209,048 | 6/1980 | Sandos | 150/38 |

*Primary Examiner*—Donald F. Norton

*Attorney, Agent, or Firm*—Wolder, Gross & Yavner

[57] ABSTRACT

A business wallet construction includes first, second and third flaps. The second and third flaps are separated by a fold line while the first flap is attached to the second flap as a hinged, free-turning appendage. The flaps further define a series of pockets and slots to permit a wide variety of items to be stored and carried within the wallet. Two removable members are provided for removable diary and note pad use.

1 Claim, 5 Drawing Figures

16
27
25
17
17a
17b
14
14d
14c
20a
20
13
22
23
15
18
12d
24
30a
30
12c
21
10
28a
26a
12
26
28

BUSINESS WALLET CONSTRUCTION

This invention relates primarily to wallet constructions and more particularly to business wallet constructions for use in holding credit cards, business cards, memo pads, check books, diaries, paper money and the like.

The market place is replete with wallets of varying designs and constructions. It is a constant search of the business man to obtain for use a business wallet construction which satisfies his needs in terms of carrying a variety of business materials in a compact structure which is easily contained in his pocket.

Such wallet constructions fall into two general categories: the first of these categories may be referred to as the pants wallet construction, whereby the left back pants pocket is usually used to contain basically a single foldable unitary wallet construction. The open position of such a wallet construction provides a full top opening into which paper money may be placed. The inside right half of the fold line usually includes some type of transparent business card and credit card holder. The other side of the inside of such wallet construction usually provides either a change purse or further convenience slots for credit and business cards. All in all, such a construction provides very little convenience in terms of the types of items necessary to the business man which may be contained.

Furthermore, the convenience is further lessened by the fact that the bulk assumed by such a wallet construction when filled is usually a strain on the business man's pants pocket. It should also be mentioned that such a construction provides an unsightly bulk for the business man.

Another category of wallet construction may be designated breast wallet construction and usually includes a construction, in closed position, measuring approximately 7"×4". Such constructions usually comprise a pair of flaps formed by a fold line in the middle of a 8"×7" total material measurement. One flap usually includes a side opening for paper money and a number of face slots for credit and business cards, or a single such slot at the top thereof for a memo pad. The other side flap is usually constructed, either for credit and business cards with a number of slots or with a paper money side opening. Of course, the paper money openings referred to in this second type of wallet construction for breast pocket convenience may also be used for holding credit card receipts or other papers. This breast wallet construction suffers from the disadvantage of leading to excessive bulk for the convenience provided and in essence provides very little convenience for the business man's use.

Accordingly, a primary object of the present invention is to provide a business wallet construction which lends itself easily to the conveniences required by the business man.

A further and more particular object of the present invention is to provide a business wallet construction lending itself easily to the convenience required by the business man and yet without concomitantly providing an excess of bulk for the business man to carry.

A further, more specific object of the present invention is to provide a business wallet construction for containing the diaries, check books, memo pads, paper money, business and credit cards, telephone directories, and the like, needed by the business man to carry out his day-to-day functions.

These and other objects of the present invention are provided in a business wallet construction which features a three flap structure in a compact yet convenient design. A second flap and a third flap are provided on opposite sides of a center fold line and a first flap is provided as a hinged free-turning appendage to the second flap. The first flap provides a horizontal front face slot into which a memo pad stiffening back may be placed and a full length pocket is provided on the opposite face from the memo pad slot in order to hold the stiffening member of a check book.

The second or middle flap, on its front face, provides horizontal slots for business or credit cards and a full length side opening for paper money insertion.

The third flap provides a full length side opening for insertion of the back cover of a bound diary with a slightly displaced, substantially full length vertical slot into which may be inserted the back cover of a phone directory, or the like. The slightly displaced slot is also convenient for inserting the securement flap of a business and credit card holder held within the back cover of the phone directory. Furthermore, the slightly displaced slot is formed by cutting a continuous piece of material forming the front face of the third flap.

Other objects, features and advantages of the present invention will become more apparent by reference to the following detailed description of a preferred, but nonetheless illustrative, embodiment of the present invention, with reference to the accompanying drawings, wherein.

Figure 1:
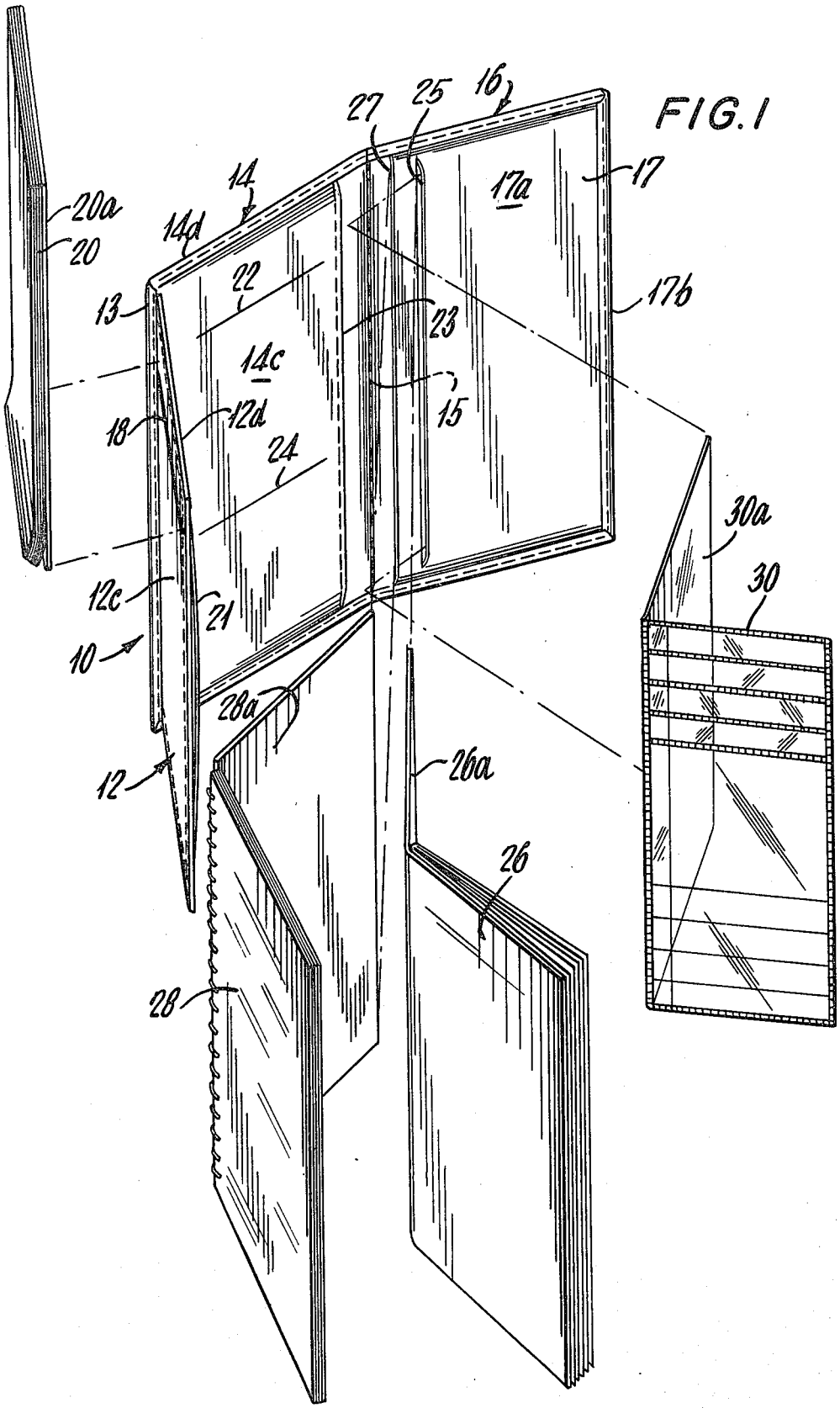
FIG. 1 is an exploded, perspective view of the invention, showing the basic unit open with the first flap in somewhat rotated position and illustrating all the inserts to be placed within the basic unit.

Referring to the drawings, a wallet construction 10 according to the present invention is shown to include basically a three flap structure. The first flap 12 is a hinged free-turning appendage 13 to the second flap 14 which is separated from the third flap 16 by a fold portion 15.

First flap 12 includes a left side **12*a*, and a right side 12*b*, and provides a horizontal front face slot 18 on front face 12*c* into which memo pad 20 may be inserted by placing stiffening back 20*a* into slot 18. The opposite or rear face 12*d* of first flap 12 defines a substantially full length side pocket 21 proximate right side 12*b*** into which may be inserted the stiffening member of a check book or other miscellaneous items (not shown).

The second or middle flap 14 includes a left side **14*a* and a right side 14*b* and defines on its front face 14*c* horizontal slots 22, 24, into which are inserted business or credit cards (not shown), and also includes rear face 14*d*. Middle flap 14 also defines side opening 23 into which is inserted paper money, notes, or the like (not shown). Second flap 14 is joined to first flap 12 at side 12*a*, 14*a* to form a free-turning hinge 13**.

Third flap 16 includes a left side 16*a* and a right side 16*b* and defines a side opening 27 for insertion of a diary 28 by means of its back cover 28*a* and a substantially full-length vertical slot 25, slightly displaced to the right of opening 27, for insertion of a telephone directory. Into the last page thereof is further inserted a transparent business and credit card holder 30, which has its securement flap 30*a* inserted into slot 25. It should be noted particularly from FIG. 1 that slot 25 is formed by cutting a continuous piece of material 17 which forms the front face 17*a* of third flap 16. In this way, when slot 25 is empty, and even when it is used, the front face of third flap 16 lies flatter than other wallet constructions and is therefore more convenient to carry. Flap 16 also includes rear face 17*b*.

Figure 5:
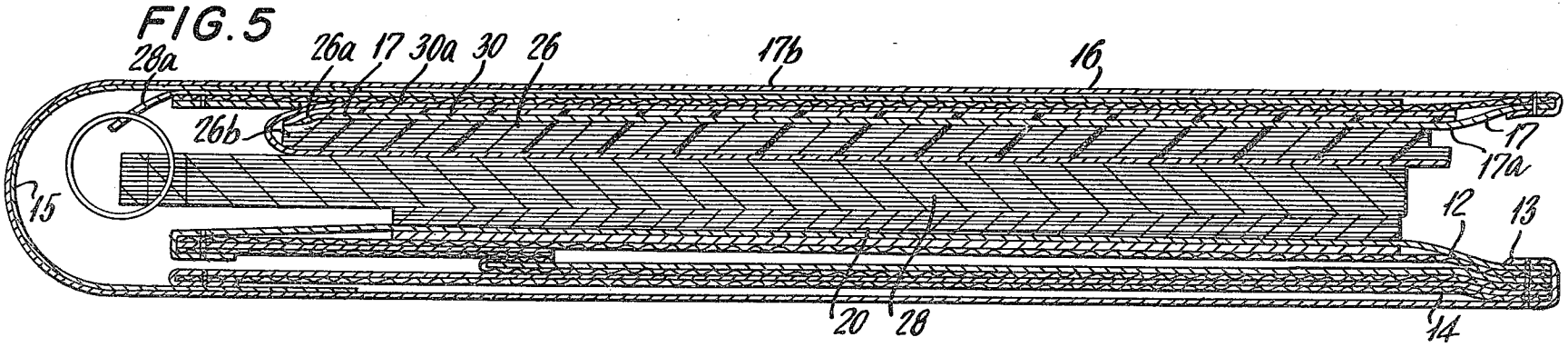
FIG. 5 is an enlarged, cross-sectional view taken along the lines 5—5 of FIG. 3.

The widths of back cover 26*a* and securement flap 30*a* are critical. As seen in FIG. 5, the width of flap 30*a* is sufficient to allow the holder 30 to be snugly positioned against piece 17. However, cover 26*a* has sufficient additional width so that holder 30 is snugly and efficiently received within the receptacle formed by cover 26*a* and the back page 26*b* of the directory 26. Thus, the thickness of the combination of directory 26 and holder 30 is as thin as possible under the circumstances, contributing to the overall compactness of the unit.

Figure 2:
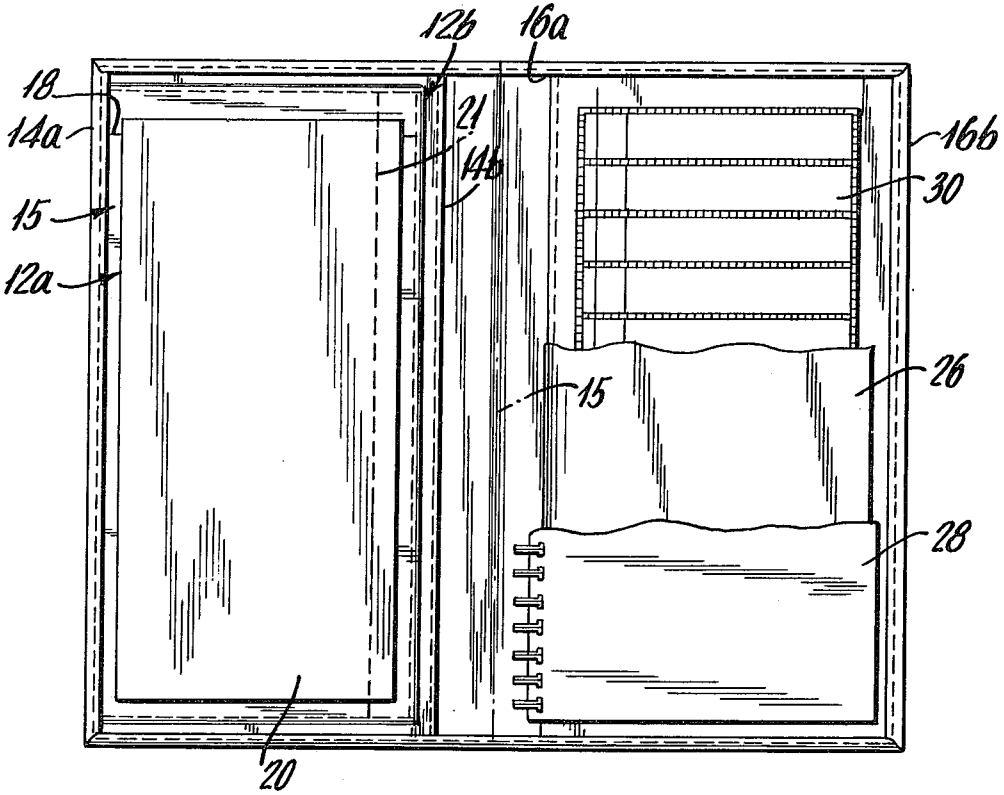
FIG. 2 is a planned view of the invention showing the first flap resting against the second flap and showing various of the inserts in position within the basic unit.
Figure 3:
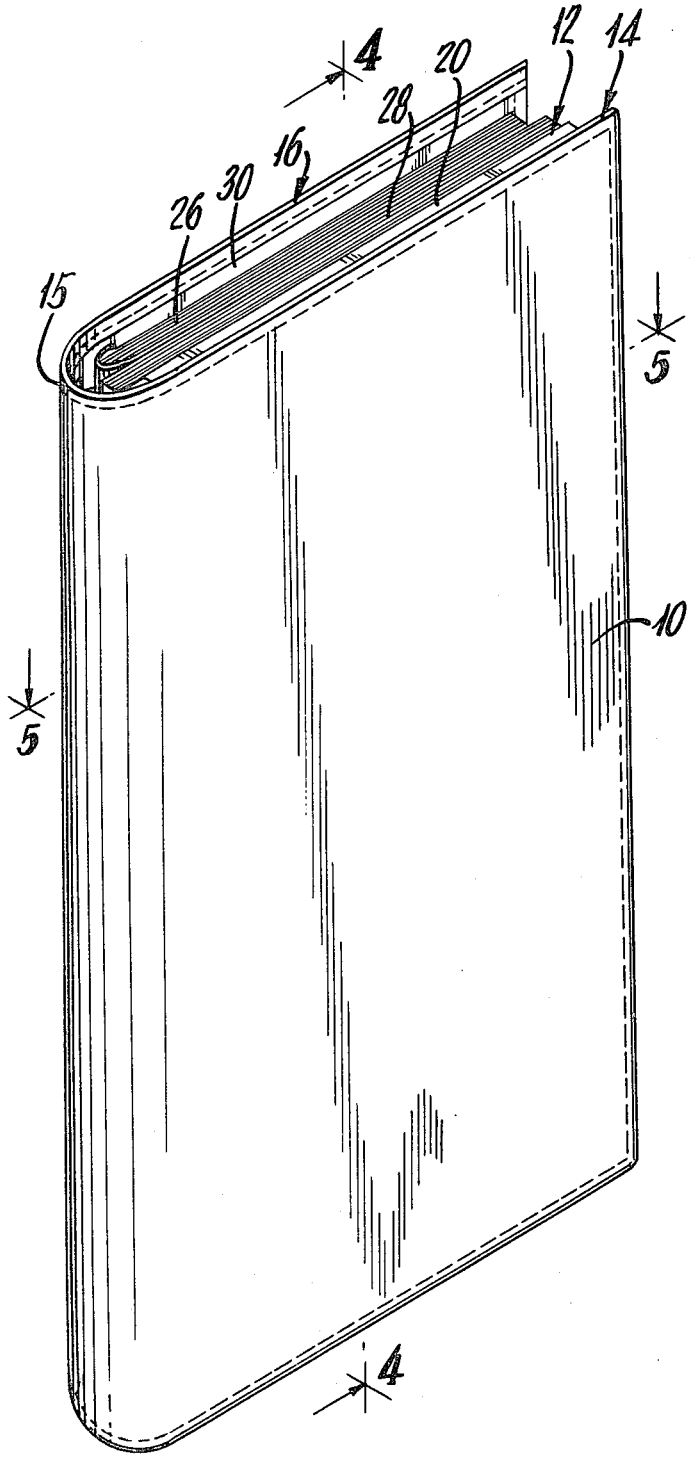
FIG. 3 is a perspective elevational view of the invention showing the basic unit in a closed condition with inserts in various appropriate positions.
Figure 4:
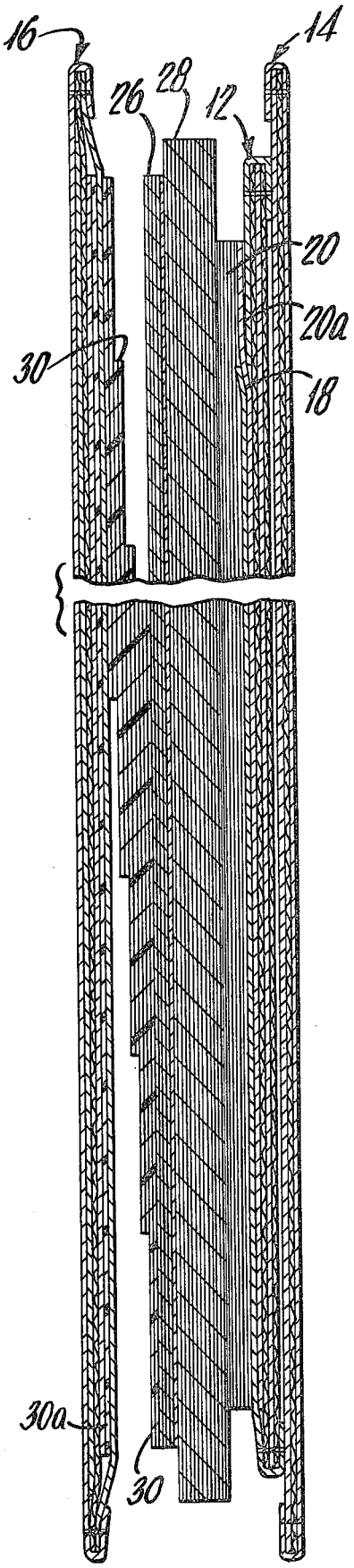
FIG. 4 is an enlarged, cross-sectional view taken along the lines 4—4 of FIG. 3.

FIGS. 2–5 show how all the aforementiond items are conventiently stored without an excess of bulk or without presenting an unsightly appearance. As shown in FIGS. 1 and 2 particularly, the convenience for use of such items 18, 20, 26, 28 and 30, is easily accomplished by the design and structure of the present invention. Removal of the items is unnecessary to obtain access to other of the items and the entire structure, as shown in FIG. 3, may be conveniently stored in a breast inside pocket of a suit jacket or for desk top use.

While the structure and convenience of the present invention has been described herein, variations of use or construction are still within the scope of the invention if within the limits of the following claims:

I claim:

1. A business wallet construction comprising first, second and third flaps, each including left and right sides and front and rear faces, a fold line separating said second and third flap, said first flap attached as a hinged free-turning appendage to the left side of said second flap, said third flap defining a substantially full length side opening into said flap adjacent said fold line and including a slightly displaced substantially full length vertical slot on said front face, said slot being cut in the material forming said front face of the third flap, a member having a securement flap, said securement flap being received within said slot, and a second member having a back cover, said back cover being received within said slot, said back cover being slightly greater in width than said securement flap, so that when said first member is inserted in said slot, said second member may then be inserted within said slot with sufficient room to accommodate said first member in order that the two members may be folded as efficiently as possible with respect to thickness within said slot.

* * * * *